US008807411B2

(12) United States Patent
Meyer

(10) Patent No.: US 8,807,411 B2
(45) **Date of Patent: *Aug. 19, 2014**

(54) STERNUM CLIP FOR PACK WITH STRAPS

(71) Applicant: Under Armour, Inc., Baltimore, MD (US)

(72) Inventor: Michael J. Meyer, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/920,671

(22) Filed: Jun. 18, 2013

(65) Prior Publication Data

US 2013/0277406 A1 Oct. 24, 2013

Related U.S. Application Data

(63) Continuation of application No. 13/219,207, filed on Aug. 26, 2011, now Pat. No. 8,464,920.

(51) Int. Cl.
*A45F 3/04* (2006.01)

(52) U.S. Cl.
USPC ..... 224/627

(58) Field of Classification Search
USPC ..... 224/627, 637, 638, 259, 262; D11/210, D11/212; 450/86; 24/265 H, 369, 199
See application file for complete search history.

(56) References Cited

U.S. PATENT DOCUMENTS

| | | | |
|---|---|---|---|
| 152,592 | A | 6/1874 | Bowne |
| 268,932 | A | 12/1882 | Poirier |
| 1,489,731 | A | 4/1924 | Baldwin |
| 1,643,502 | A | 6/1926 | King |
| 2,089,474 | A | 8/1937 | Glick |
| 2,123,984 | A | 7/1938 | Baer |
| 2,602,929 | A | 7/1952 | Chasinov |
| 4,414,716 | A | 11/1983 | Stastney |
| 4,612,935 | A | 9/1986 | Greifer |
| 4,858,249 | A | 8/1989 | Stewart |
| 4,946,198 | A | 8/1990 | Pittore et al. |
| 5,080,396 | A | 1/1992 | Vacanti |
| 5,630,536 | A | 5/1997 | Bugnaski |
| 5,902,016 | A | 5/1999 | Moran et al. |
| 5,931,503 | A | 8/1999 | Glendon |
| 5,935,044 | A | 8/1999 | Brewster |
| 5,961,014 | A | 10/1999 | Knerr |
| 5,964,642 | A | 10/1999 | Fildan |
| 6,163,937 | A | 12/2000 | McKinnis et al. |
| 6,279,208 | B1 | 8/2001 | Gillis |
| 6,381,752 | B1 | 5/2002 | Cartelli |
| 6,435,391 | B1 | 8/2002 | Vazquez |
| 6,808,099 | B2 | 10/2004 | Nykoluk |
| 7,278,900 | B1 | 10/2007 | Ostaseski |
| D572,626 | S | 7/2008 | Merriam-Smith |

(Continued)

*Primary Examiner* — Justin Larson
(74) *Attorney, Agent, or Firm* — Maginot, Moore & Beck LLP

(57) ABSTRACT

A backpack assembly includes a pack configured to be worn on a wearer's back. The backpack assembly also includes straps coupled to the pack and configured to extend over the wearer's chest. The straps include at least one first side strap and at least one second side strap. The backpack assembly also includes a strap retainer. The strap retainer includes a closed loop on a first side of the strap retainer and an open loop on a second side of the strap retainer. The at least one first side strap is slidably retained within the closed loop and the at least one second side strap is slidably retained within the open loop. The open loop also includes a side opening through which the at least one second side straps can be inserted and removed.

18 Claims, 4 Drawing Sheets

(56) References Cited

U.S. PATENT DOCUMENTS

| | | | |
|---|---|---|---|
| 7,410,407 | B2 | 8/2008 | Krammel |
| D583,706 | S | 12/2008 | Gilbert |
| 7,601,048 | B2 | 10/2009 | Groner |
| D603,293 | S | 11/2009 | Merriam-Smith |
| D619,807 | S | 7/2010 | Hock |
| 7,753,758 | B1 | 7/2010 | Arrington |
| 7,785,171 | B1 | 8/2010 | Baker |
| 8,087,130 | B2 | 1/2012 | Chan |
| 2006/0005576 | A1 | 1/2006 | Detsis |
| 2009/0020580 | A1 | 1/2009 | Tate |
| 2009/0235435 | A1 | 9/2009 | Baker et al. |
| 2009/0276983 | A1 | 11/2009 | Chan |
| 2010/0173564 | A1 | 7/2010 | Michael |
| 2010/0224660 | A1 | 9/2010 | Gleason |

STERNUM CLIP FOR PACK WITH STRAPS

CROSS-REFERENCE TO RELATED APPLICATIONS

This application is a continuation of U.S. patent application Ser. No. 13/219,207, filed Aug. 26, 2011, now U.S. Pat. No. 8,464,920.

FIELD

This invention relates generally to sack packs and specifically to a retainer for the straps of a sack pack.

BACKGROUND

Carrying bags come in a wide variety of forms and styles. A backpack style carrying bag, commonly called a backpack, may be useful for some applications because it allows the user to distribute the weight of the bag over both shoulders and the back. Additionally, both of the user's hands may be free while carrying a backpack.

Backpacks are also found in a variety of forms. Trekking backpacks, used for hiking and camping expeditions, may include internal or external frames made of carbon fiber or aluminum, have capacities of 100 liters, include additional straps that cross the wearer's chest, waist and hips to better distribute weight and weigh 8 pounds when empty. For everyday use, a trekking backpack may be unnecessarily large and bulky and a smaller, simpler backpack may meet the user's needs. For example, for transporting a few lightweight items, cinch sacks or sack packs (which may also be referred to as drawstring backpacks) with capacities of around 8 liters and weights of just a few ounces may be sufficient. Drawstring backpacks are designed with straps that double as drawstrings to control the opening at the top of the bag. This design allows for simplicity as the assembly may require as little as a simple sack and two drawstrings resulting in relatively low manufacturing costs for the drawstring backpacks.

Due to the simplicity of sack packs and their typical use for a few lightweight items, the straps may have a tendency to slide off users' shoulders. In view of the foregoing, it would be advantageous to provide a sack pack with a device which retains the straps on the users' shoulders while maintaining the simplicity and utility of the sack pack style of backpack.

SUMMARY

In accordance with one embodiment of the disclosure, there is provided a backpack assembly including a pack configured to be worn on a wearer's back, straps coupled to the pack and configured to extend over the wearer's chest, said straps including at least one first side strap and at least one second side strap. The backpack assembly also includes a strap retainer including a closed loop on a first side of the strap retainer, wherein the at least one first side strap is slidably retained within the closed loop. The strap retainer also includes an open loop on a second side of the strap retainer, wherein the open loop is configured to slidably retain the at least one second side strap. The open loop includes a side opening through which the at least one second side straps can be inserted and removed.

In accordance with another embodiment of the disclosure, there is provided a backpack assembly including a pack configured to be worn on a wearer's back and cords coupled to the pack. The cords are configured to extend over the wearer's chest and are arranged as drawstrings for the pack. The backpack assembly also includes a cord retainer including a first cord retaining portion configured to slidably engage the cords, and an opposite second cord retaining portion configured to slidably engage the cords.

In accordance with yet another embodiment of the disclosure, there is provided a backpack assembly including a pack configured to be worn on a wearer's back, straps coupled to the pack and a sternum clip. The straps are configured to extend over the wearer's chest and are arranged as drawstrings for the pack. The sternum clip includes a posterior portion, a first side with a first fold over portion that contacts the posterior portion, a second side with a second fold over portion that does not contact the posterior portion and an opening created between the second fold over portion and the posterior portion. The opening is configured to pass said straps therethrough.

The above described features and advantages, as well as others, will become more readily apparent to those of ordinary skill in the art by reference to the following detailed description and accompanying drawings. While it would be desirable to provide an article to be carried that provides one or more of these or other advantageous features, the teachings disclosed herein extend to those embodiments which fall within the scope of the appended claims, regardless of whether they accomplish one or more of the above-mentioned advantages.

DESCRIPTION

With general reference to FIGS. 1-5, a backpack assembly 10 to be worn or carried by a human user is shown. The backpack assembly 10 is meant to be worn or carried with a pack 12 on the user's back. The backpack assembly 10 includes the pack 12 which retains the user's belongings and two straps 20 which are connected to the pack 12 and are designed and dimensioned to extend over the user's shoulders and chest while the backpack assembly 10 is in use. The backpack assembly 10 also includes a sternum clip 30 which is slidably attached to the straps 20. When the backpack assembly 10 is in use, the user wears the straps 20 over his shoulders and retains the straps 20 close together over his sternum in a sternum clip 30.

Figure 1:
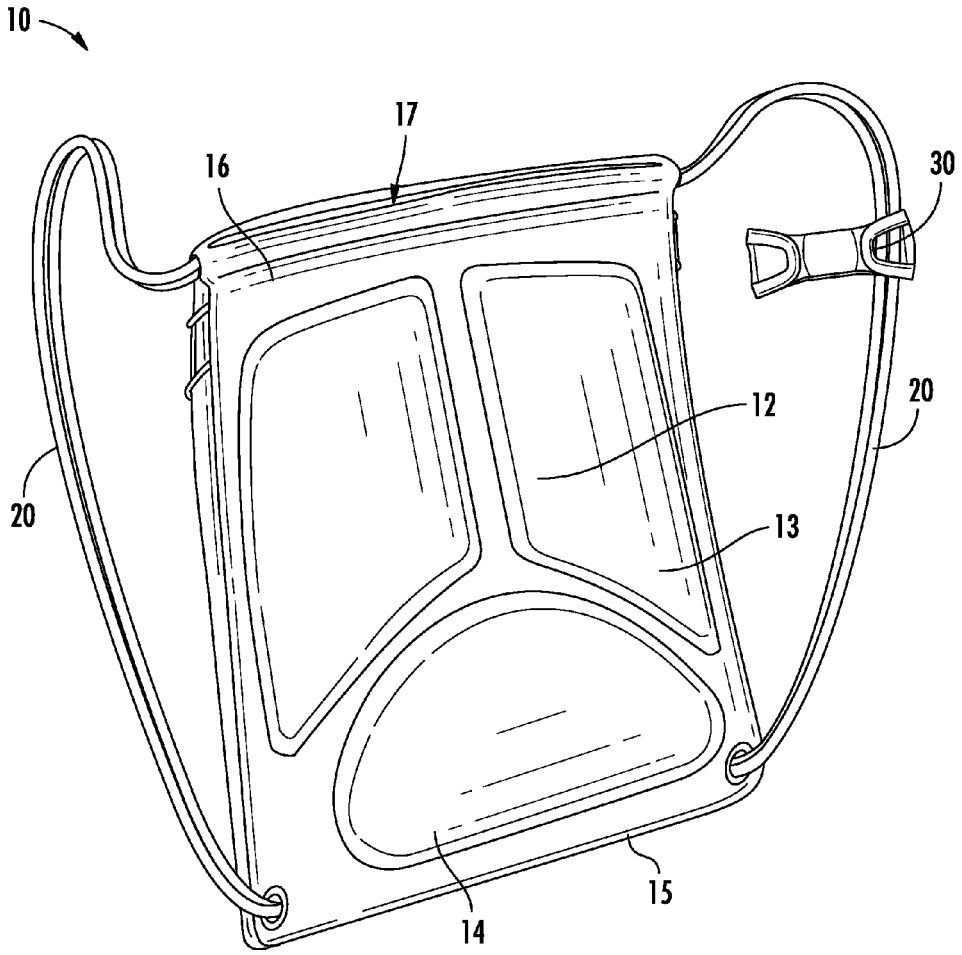
FIG. 1 shows a backpack assembly including a sternum clip attached to one of the straps.

The pack 12 may be provided in any number of different forms. One exemplary form of the pack 12 is shown in FIG. 1. The pack 12 includes a body portion 13 which is closed at a bottom portion 14 and includes a mouth 17 at a top portion 16. The mouth 17 may be closed by a drawstring. Typically, the straps 20 serve as the drawstring such that pulling on the straps 20 will cinch closed the mouth 17 at the top portion 16 of the pack 12. This type of pack 12 is commonly known as a "sack pack" or a "cinch sack." It will be recognized, however, that the pack 12 may be a bag provided in any number of different forms.

Figure 2:
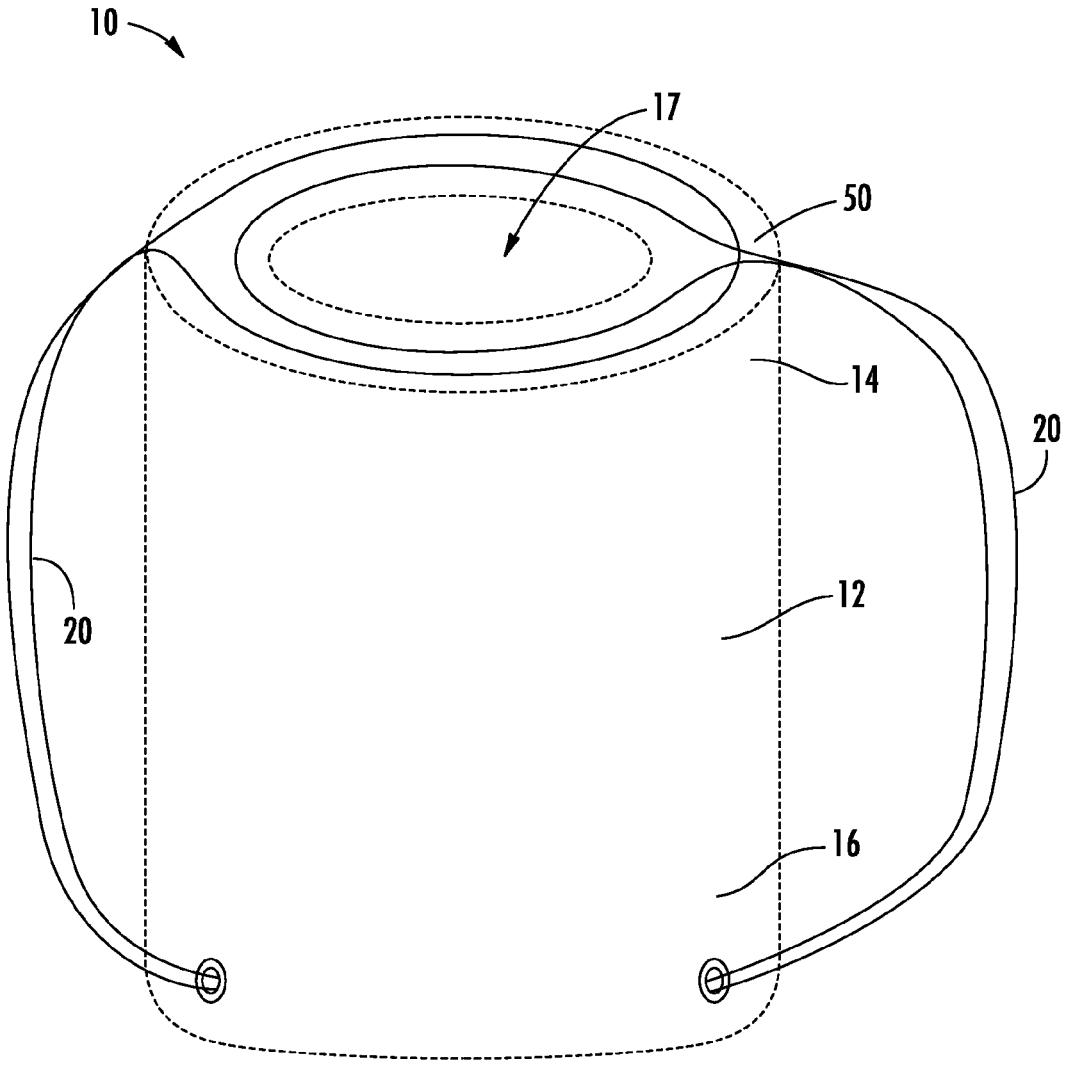
FIG. 2 shows the backpack assembly of FIG. 1 with a drawstring configuration.

The straps 20 are coupled to the pack 12 and are configured to extend over the user's chest. The straps 20 are coupled to the bottom portion 14 of the pack 12 and extend to the top portion 16 of the pack 12. At the top portion 16 of the pack 12, the straps 20 are coupled to the pack 12 in such a way as to provide the drawstrings for the backpack assembly 10 to cinch the mouth 17 when the straps 20 are pulled on the backpack assembly 10. For example, as shown in FIG. 2, the straps may extend through a channel 50 formed along the perimeter of the mouth 17 of the pack. Such an arrangement allows the backpack assembly to be used as a sack pack, such that pulling on the straps 20 draws the mouth 17 of the pack 12 shut. However, it will be recognized that in other embodiments, the straps 20 may be configured differently, as the straps 20 may be connected to the bottom portion 14 and the top portion 16 of the pack 12 in any way which allows the straps 20 to be worn over the user's shoulders while the backpack assembly 10 is in use.

The straps 20 may be provided in a number of different forms. For example, the straps 20 may be in the form of strings or cords. The straps 20 may be in any form which is flexible and can be coupled to the bottom portion 14 of the bag and serve as drawstrings at the top portion 16 of the pack 12. In one embodiment, the straps 20 may be made of a material which has an elastic component, such as elastane fibers. This allows the straps 20 to stretch longitudinally to better accommodate the user and the pack 12.

The sternum clip 30 is slidably coupled to the straps 20 so that it may rest on the sternum of the user when the backpack assembly 10 is in use. Put another way, when in use, the sternum clip 30 retains the straps 20 in a configuration so that they are close together and remain positioned on or near the user's chest. Thus, the sternum clip 30 may also be referred to as a "strap retainer" or a "cord retainer".

Figure 3:
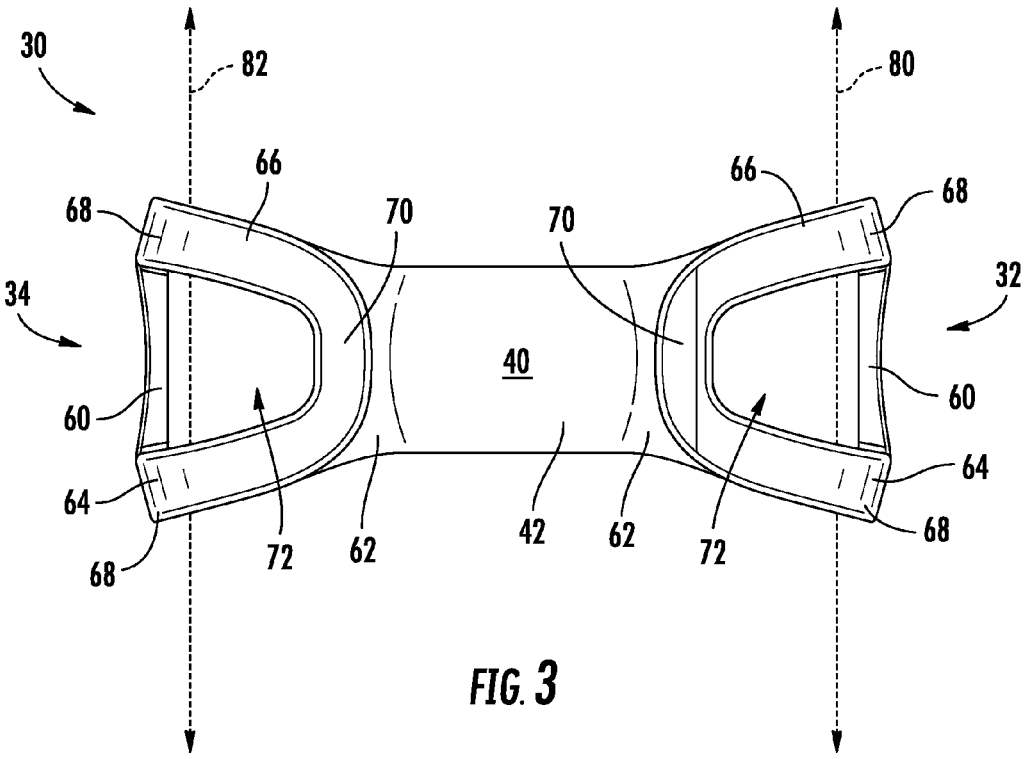
FIG. 3 shows a front view of the sternum clip of FIG. 1.
Figure 4:
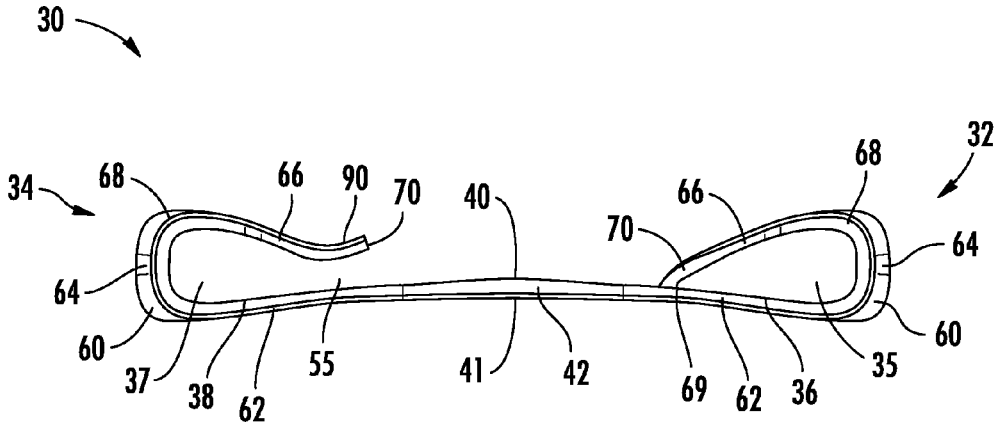
FIG. 4 shows a side view of the sternum clip of FIG. 1.

As shown in more detail in FIGS. 3-4, the sternum clip 30 is provided as a unitary component that includes an inner surface 40, an outer surface 41, a first side 32, a second side 34 and a central portion 42. The first side 32 of the sternum clip 30 is configured to retain the straps 20 from one side of the pack 12. The second side 34 of the sternum clip 30 is configured to retain the straps 20 from the opposite side of the pack 12. The central portion 42 is a substantially rectangular plate member positioned between the first side 32 and the second side 34 of the sternum clip 30. From a front view, the first side 32 and the second side 34 of the sternum clip 30 are flared relative to the central portion 42.

The first side 32 and the second side 34 of the sternum clip 30 include wings 60 that extend from the central portion 42 of the sternum clip 30. Each wing 60 includes a posterior portion 62, a curved portion 64 and an anterior portion 66. The posterior portion 62 is a plate-like member that extends away from the central portion 42 of the sternum clip 30 in a lateral direction. The posterior portion 62 merges into the curved portion 64. The curved portion 64 forms a bend in the wing 60 that curves approximately 180°. The anterior portion 66 is formed as a C-shaped band that extends from the curved portion 64 and toward the central portion 42 of the sternum clip 30. (The C-shape of the anterior portion 66 is visible in FIG. 3.) The anterior portion 66 is generally an arc-shaped band, with the ends 68 of the arc-shaped band connected to the curved portion 64, and the vertex 70 of the arc-shaped band positioned closer to the central portion 42 of the sternum clip 30. Because the anterior portion 66 is generally arc-shaped, a window 72 (shown in FIG. 3) is formed in the center of the ventral portion. This window 72 exposes the inner surface 40 at the sides 32, 34 of the sternum clip 30 when the sternum clip is viewed from the front, such as the view shown in FIG. 3.

With particular reference now to FIG. 4, the wings 60 on the first side 32 and the second side 34 of the sternum clip 30 are differently configured. The wing 60 on the first side 32 of the sternum clip 30 forms a closed loop 36 which is configured to surround the straps 20 from one side of the pack 12. In particular, the anterior portion 66 of the wing 60 on the first side 32 engages the posterior portion 62 of the wing 60 of the sternum clip 30 near the central portion 42. Thus, a closed loop 36 is formed by the posterior portion 62, curved portion 64 and anterior portion 66 of the wing 60 on the first side 32 of the sternum clip 30. This closed loop 36 forms a first passage 35 in the sternum clip 30, which is defined along first axis 80 (shown in FIG. 3). The first passage 35 is sufficient in size to receive the straps 20 and allow the straps 20 to slide within the first passage 35. However, the first passage 35 does not include any side openings (i.e., no openings in a direction perpendicular to first axis 80) that would allow the straps 20 to pass out of the closed loop 36. Thus, the sternum clip 30 remains coupled to the straps 20 when the straps 20 slide within the first passage 35. Although the first side 32 of the sternum clip 30 is moveable along the straps 20, the straps cannot be inserted or removed from the sternum clip 30 if the ends of the strap 20 are coupled to the pack 12. The closed loop 36 that forms the first passage 35 may also be referred to herein as a "first strap engaging portion" or a "first strap retaining portion."

The wing 60 on the second side 34 of the sternum clip 30 forms an open loop 38 which is configured to engage straps 20 from the opposite side of the pack 12. In particular, the anterior portion 66 of the wing 60 on the second side 34 does not engage the posterior portion 62 of the wing 60 of the sternum clip 30 near the central portion 42 but leaves an opening 55 between the anterior portion 66 and the posterior portion 62 of the second side 34. Thus, an open loop 38 is formed by the posterior portion 62, curved portion 64 and anterior portion 66 of the wing 60 on the second side 34 of the sternum clip 30. This open loop 38 forms a second passage 37 in the sternum clip 30, which is defined along second axis 82 (shown in FIG. 3). The second passage 37 is sufficient in size to receive the straps 20 and allow the straps 20 to slide within the second passage 37. Additionally, the second passage 37 includes opening 55 in a direction perpendicular to second axis 82 that allows the straps 20 to pass out of the open loop 38. The opening 55 has a dimension that is generally less than the width of the straps 20. Accordingly, the straps 20 may be slightly compressed to force the straps 20 through the opening 55 and into the second passage 37. Thus, the second side 34 of the sternum clip 30 remains coupled to the straps 20 when the straps 20 slide within the second passage 37. Additionally, the second side 34 of the sternum clip 30 is moveable along the straps 20 and the straps 20 can be inserted and removed from the sternum clip 30 through the opening 55 while the ends of the strap 20 remain coupled to the pack 12. The open loop 38 that forms the second passage 37 may also be referred to herein as a "second strap engaging portion" or a "second strap retaining portion."

The sternum clip 30 in the embodiment disclosed in FIGS. 3 and 4 may be considered to be "bow-tie" shaped. In other words, the clip 30 has a narrower central area (i.e., central portion 42) and wider ends (i.e., the first side 32 and second side 34) that extend outwardly from the central area. The first side 32 of the bow-tie shaped clip 30 includes the curved portion 64 and the anterior portion 66, which may be collectively referred to as "a first fold over portion". This first fold-over portion causes the inner surface 40 of the sternum clip 30 to make a turn of about 180° and move at an angle back toward the central portion 42 until the inner surface 40 merges with itself at an intersection point 69 near the central portion 42. As a result, the inner surface 40 on the first side 32 results in the closed loop 36 such that the inner surface 40 on the anterior portion 66 actually engages the inner surface 40 on the posterior portion 62. As explained previously, the closed loop 36 formed by this engagement forms a first passage 35 on the first side 32 of the sternum clip 30 that is configured to receive the straps 20 and allow the straps 20 to slide therethrough. Although the straps 20 on the first side 32 of the sternum clip 30 are slidably retained within the closed first passage 35, they cannot be inserted or removed from the closed first passage 35 on the first side 32 of the sternum clip 30 because of the contact between the anterior portion 66 and the posterior portion 62.

The second side 34 of the bow-tie shaped clip 30 includes the curved portion 64 and the anterior portion 66, which may be collectively referred to as "a second fold over portion". This second fold-over portion causes the inner surface 40 of the sternum clip 30 to make a turn of about 180° and move at an angle back toward the central portion 42 but the inner surface 40 does not merge with itself. Instead, the second fold-over portion includes a side opening 55 (shown in FIG. 4). As a result, the inner surface 40 on the second side 34 results in the open loop 38 such that the inner surface 40 on the anterior portion 66 does not engage the inner surface 40 on the posterior portion 62. As explained previously, the open loop 38 formed by this arrangement forms a second passage 37 on the second side 34 of the sternum clip 30 that is configured to receive the straps 20 and allow the straps 20 to slide therethrough. The straps 20 on the second side 34 of the sternum clip 30 are slidably retained within the second passage 37 and can be inserted and removed from the second passage 37 on the second side 34 of the sternum clip 30 through the opening 55 between the second fold over portion and the surface 40.

As shown in FIG. 4, the second fold over portion may include a lip 90 which is flared away from the surface 40 to help guide the strap 20 through the opening 55. Additionally, the surface 40 may be slightly convex such that the central portion 42 does not lie in the same plane as the lowest parts of the first side 32 and second side 34.

The sternum clip 30 may be formed in a number of different ways. For example, the first side 32, the second side 34, and the central portion 42 may be formed together as a single molded piece with non-removable components. The clip 30 may be formed by any of various methods known in the art, such as injection molding, using any of various materials known in the art, such as PVC or other polymers. In one alternative embodiment, the first side 32 and the second side 34 are not provided as a single piece, and instead the first side 32 or the second side 34 is removable from the central portion 42 and formed as separate molded pieces. If the first side 32 or the second side 34 is formed as a separate molded piece, the central portion 42 of the sternum clip 30 will include a connector or a connector portion configured to releasably couple the separate components. The central portion 42 may be made in any way which allows it to securely couple the first side 32 to the second side 34 and thus the closed loop 36 to the open loop 38. In one embodiment, the central portion 42 may be relatively flexible and resilient to provide some compliance and comfort during use. In another embodiment, the central portion 42 may be bendable to facilitate inserting and removing the strap 20 in the second side 34 by providing more clearance to the opening 55.

Figure 5:
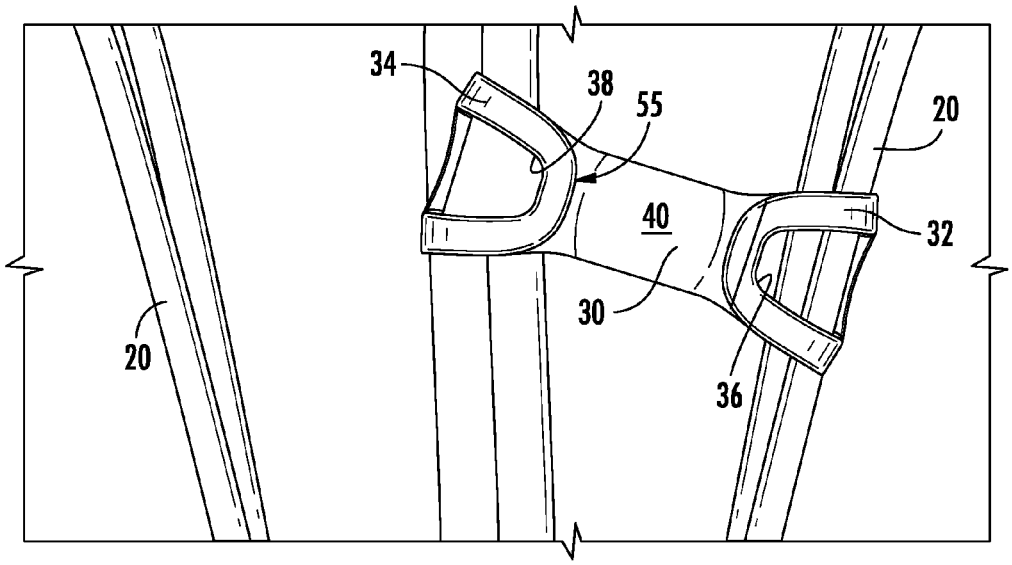
FIG. 5 shows the sternum clip of FIG. 1 in use in an uncoupled position.
Figure 6:
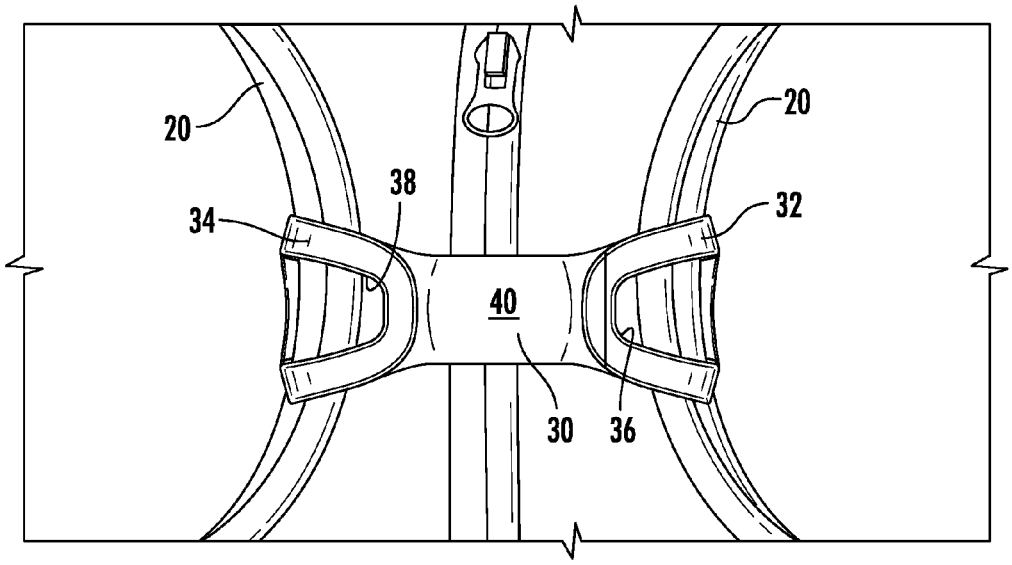
FIG. 6 shows the sternum clip of FIG. 1 in use in a coupled position.

In use, the user of the backpack assembly 10 places his arms through the straps 20 so that the pack 12 rests on his back. The user now has the backpack assembly 10 in the uncoupled position as shown in FIG. 5. The straps 20 are slidably retained within the closed loop 36 on the first side 32 of the sternum clip 30 and are not inserted into the opening 55 in the open loop 38 on the second side 34 of the sternum clip 30. The user then inserts the straps 20 through the opening 55 in the open loop 38 so that the backpack assembly 10 is in the coupled position as shown in FIG. 6. The straps 20 are slidably retained within the closed loop 36 on the first side 32 of the sternum clip 30 and also within the open loop 38 on the second side 34 of the sternum clip 30. The user may now wear the backpack assembly 10 without having to worry about the straps 20 sliding off his shoulders and will be able to carry his belongings hands-free.

The foregoing detailed description of one or more embodiments of the sack pack sternum clip has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems, or applications. Presently unforeseen or unanticipated alternatives, modifications, variations or improvements therein may be subsequently made by those skilled in the art which are also intended to be encompassed by the appended claims. Therefore, the spirit and scope of any appended claims should not be limited to the description of the embodiments contained herein.

What is claimed is:

1. A backpack assembly comprising:

a pack configured to be worn on a back of a wearer;

straps coupled to said pack and configured to extend over a chest of the wearer, the straps including a first side strap and a second side strap; and a strap retainer including:

a closed loop on a first side of the strap retainer, the closed loop forming a first passage along a first axis, wherein the first side strap extends through the first passage such that the closed loop is free to slide along the at least one first side strap in a direction of the first axis and allow a position of the strap retainer on the straps to be adjusted; and an open loop on a second side of the strap retainer, wherein the open loop is configured to slidably retain said at least one second side strap, said open loop including a side opening through which said at least one second side straps can be inserted and removed in a direction substantially perpendicular to the first axis; and a central portion positioned between said closed loop and said open loop, wherein said closed loop and said open loop are flared relative to said central portion such that said strap retainer has a bow-tie shape.

2. The backpack assembly of claim 1, wherein said strap retainer further includes an inner surface and an outer surface, wherein said closed loop includes a foldover portion with an engagement point where the inner surface merges into itself, and wherein said open loop includes a foldover portion that does not include an engagement point where the inner surface merges into itself.

3. The backpack assembly of claim 1, wherein said strap retainer is a single molded piece.

4. The backpack assembly of claim 1, said strap retainer further including a central portion, wherein said closed loop is a single molded piece, said open loop is a single molded piece and said central portion couples said closed loop to said open loop.

5. The backpack assembly of claim 1, wherein the closed loop includes a posterior portion, an anterior portion, and a curved portion positioned between the anterior portion and the posterior portion, and wherein the anterior portion engages the posterior portion.

6. The backpack assembly of claim 1, wherein said straps are cords comprising an elastic component.

7. A backpack assembly including:

a pack configured to be worn on a back of a wearer;

cords coupled to said pack and configured to extend over a chest of said wearer, said cords arranged as drawstrings for said pack; and a cord retainer including:

a first cord retaining portion configured to slidably engage said cords, said first cord retaining portion including a closed loop configured to surround said cords, an opposite second cord retaining portion configured to slidably engage said cords, said second cord retaining portion including an open loop through which said cords can be inserted and removed, and a central portion positioned between said closed loop and said open loop, wherein said closed loop and said open loop are flared relative to said central portion such that said cord retainer has a bow-tie shape.

8. The backpack assembly of claim 7, wherein said cord retainer is a single molded piece.

9. The backpack assembly of claim 8, wherein said second cord retaining portion includes a lip to guide said cords into said open loop.

10. The backpack assembly of claim 8, wherein the closed loop includes a posterior portion, an anterior portion, and a curved portion positioned between the anterior portion and the posterior portion, and wherein the anterior portion engages the posterior portion.

11. The backpack assembly of claim 8, wherein the open loop includes a posterior portion, an anterior portion, and a curved portion positioned between the anterior portion and the posterior portion, and wherein the anterior portion does not engage the posterior portion.

12. The backpack assembly of claim 8 wherein the closed loop forms a first passage along a first axis, wherein one of the cords extends through the first passage such that the closed loop is free to slide along the cord in a direction of the first axis and allow a position of the cord retainer to be adjusted relative to the wearer.

13. A method of arranging a backpack assembly on a wearer, the method comprising:

inserting arms of the wearer between a first strap and a pack and a second strap and the pack such that the pack is positioned on the wearer's back and the first strap and the second strap extend over a chest of the wearer, the straps arranged as drawstrings for the pack; and adjusting a strap retainer along the first strap by sliding the strap retainer along the first strap with the first strap extending through a passage of the strap retainer defining a first axis on a closed loop side of the strap retainer, the strap retainer including a central portion positioned between said closed loop side an said open loop side, wherein said closed loop side and said open loop side are flared relative to said central portion such that said strap retainer has a bow-tie shape; and coupling an open loop side of the strap retainer to the second strap by inserting the second strap through a side opening of the open loop in a direction substantially perpendicular to the first axis.

14. The method of claim 13, further comprising decoupling the open loop side of the strap retainer from the second strap by moving the second strap through the side opening of the open loop in a direction opposite the direction substantially perpendicular to the first axis.

15. The method of claim 13, further comprising further adjusting a strap retainer along the first strap and the second strap with the strap retainer coupled to both the first strap and the second strap by sliding the first strap along the passage defining the first axis on the closed loop side of the strap retainer and also sliding the second strap along another passage substantially parallel to the first axis on the open loop side of the strap retainer.

16. The method of claim 13, wherein said strap retainer includes a central portion between the closed loop side and the open loop side, wherein said closed loop side and said open loop side are flared relative to said central portion such that said strap retainer has a bow-tie shape.

17. The method of claim 16, wherein said straps are made of a material including an elastic component.

18. The method of claim 16, wherein said strap retainer is a single molded piece such that the closed loop side is fixedly connected to the open loop side by the central portion.

* * * * *